United States Patent [19]

Monter et al.

[11] Patent Number: 4,942,286

[45] Date of Patent: Jul. 17, 1990

[54] APPARATUS FOR HEATING A MIRROR OR THE LIKE

[75] Inventors: Robert P. Monter; Ronald L. Smith, both of Dayton, Ohio

[73] Assignee: Thermacon, Inc., Dayton, Ohio

[21] Appl. No.: 307,051

[22] Filed: Feb. 6, 1989

Related U.S. Application Data

[63] Continuation-in-part of Ser. No. 120,325, Nov. 13, 1987, abandoned.

[51] Int. Cl.[5] ..... H05B 3/84

[52] U.S. Cl. ..... 219/219; 219/541; 219/504; 219/549

[58] Field of Search ..... 219/219, 541, 504, 505, 219/522, 203, 528, 529, 548, 549; 350/588, 582; 338/308, 309

[56] References Cited

U.S. PATENT DOCUMENTS

| | | | |
|---|---|---|---|
| 3,798,419 | 3/1974 | Maake | 219/219 |
| 4,177,446 | 12/1979 | Diaz | 219/549 |
| 4,327,282 | 4/1982 | Nauerth | 219/541 |
| 4,368,380 | 1/1983 | Igashira | 219/541 |
| 4,404,463 | 9/1983 | Eder | 219/541 |
| 4,628,187 | 12/1986 | Sekiguchi | 219/505 |
| 4,728,779 | 3/1988 | Kotani | 219/505 |

FOREIGN PATENT DOCUMENTS

| | | | |
|---|---|---|---|
| 2530937 | 1/1977 | Fed. Rep. of Germany | 219/219 |

*Primary Examiner*—Teresa J. Walberg

*Attorney, Agent, or Firm*—Jacox & Meckstroth

[57] ABSTRACT

A layer of conductive polymer having a positive temperature coefficient (PTC) of resistivity and a unifrom thickness, is laminated between copper foils to form a composite sheet which is die-cut to form a planar heater assembly. A small portion of the laminated heater assembly is bent laterally outwardly to form a connector tab, and the heater assembly is adhesively bonded to the back surface of a rear view mirror having a corresponding shape and size. A plastic case supports the mirror and spring-like electrical contact terminals which engage the copper foils on the tab, and the terminals are connected to electrical conductors to provide for heating the entire mirror according to variations in temperature on the mirror surface. The tab may be lanced from the heater assembly or be formed from a projecting edge portion, and the heater assembly may be enclosed within a flexible plastic film to provide resistance to chemical corrosion. In another embodiment, the foils are connected by rivets and insulating sleeves to corresponding electrical tabs or terminals located on the inner side of the heater assembly.

7 Claims, 2 Drawing Sheets

APPARATUS FOR HEATING A MIRROR OR THE LIKE

RELATED APPLICATION

This application is a continuation-in-part of application Ser. No. 120,325, filed Nov. 13, 1987 now abandoned.

BACKGROUND OF THE INVENTION

In the art of electrical heating elements for rear view mirrors used on motor vehicles, for example, as disclosed in U.S. Pat. Nos. 3,052,787, 4,237,366, 4,410,790 and 4,631,391, it is known to use self-regulating electrical resistance heater disks of a ceramic positive temperature coefficient of resistivity (PTC) which are connected to the low voltage DC power supply of the motor vehicle. The PTC heaters are usually formed in the shape of a disk or platelets which are placed in contact between electrically conductive plates, and one of the plates is attached to the back surface of the mirror as shown in above mentioned U.S. Pat. No. 4,631,391. The heat generated by the PTC discs or platelets is conducted by the metal plate over the back surface of the mirror to melt ice and/or snow in contact with the mirror and to defrost the mirror. The metal plate in contact with the mirror conducts the heat generally uniformly across the entire back surface of the mirror even though the mirror surface temperature is not uniform due to the ice or snow. In addition, the cost of producing mirrors with heater assemblies such as shown in the above patents is relatively high, primarily in view of the labor involved in the manufacturing of the mirror and heater assemblies.

SUMMARY OF THE INVENTION

The present invention is directed to improved apparatus for electrically heating an article such as a rear view mirror used on a motor vehicle. The heating is performed according to variations in temperature of different areas of the mirror by producing higher wattage heating in the areas of lower temperatures. Thus the heater apparatus of the invention is effective to sense the location of ice and/or snow on a rear view mirror and to direct additional electrical energy to those areas of the mirror in contact with the ice or snow. The electrical heating apparatus of the invention is also economical to produce and to attach electrical conductor wires in order to simplify assembly of the mirror and heating apparatus. The invention further provides for a heater assembly which is enclosed within a film of plastics material to provide protection against corrosive chemicals.

The above advantages and features are provided in accordance with one embodiment of the invention wherein a layer of conductive PTC polymer having a uniform thickness is laminated between a pair of metal or copper foils to form a flat laminated sheet. The sheet is die-cut to form a planar heater assembly having substantially the same shape and size as the mirror. A portion of the laminated heater assembly is bent or formed laterally outwardly to form an electrical connecting tab, and a pair of electrical conductors are connected to the heater assembly by spring terminals which slide onto and grip the metal foils on the tab. Protection of the heater assembly from corrosive sprays or chemicals is provided by enclosing the heater assembly within a film of plastics material which surrounds the heater assembly and carries a pressure sensitive adhesive for attaching the enclosed heater assembly to the back surface of a mirror.

Other features and advantages of the invention will be apparent from the following description, the accompanying drawing and the appended claims.

DESCRIPTION OF THE PREFERRED EMBODIMENTS

Figure 1:
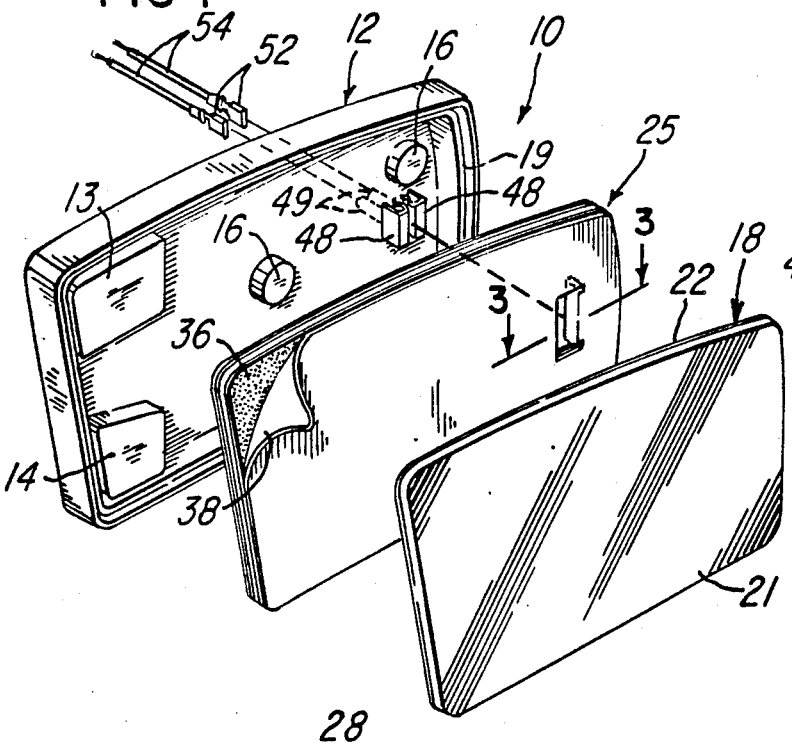
FIG. 1 is an exploded perspective view of a mirror and heater assembly constructed in accordance with the invention.

FIG. 1 shows a rear view mirror assembly 10 for a motor vehicle or automobile and which is commonly supported for universal pivoting movement within a surrounding cowling (not shown). The mirror assembly 10 includes a support case 12 which is molded of a rigid plastics material and is formed with support bosses 13, 14 and 16 defining a planar surface. In a conventional mirror assembly, the bosses 13, 14 and 16 of the case 12 support a mirror 18 which has substantially the same shape as the case 12 but is slightly smaller in order to seat within a peripheral recess 19 in the case 12. The mirror 18 includes a flat glass panel or sheet 21 on which is applied a chrome reflecting coating 22. The coating 22 may be applied to either the front surface or the rear surface of the mirror.

In accordance with the present invention, a heater assembly 25 is confined between the mirror 18 and the supporting bosses 13, 14 and 16 and has substantially the same shape as the mirror 18 but is slightly smaller. The heater assembly 25 includes a core layer 28 of a conductive polymer having a positive temperature coefficient (PTC) of resistivity. The polymer is formulated in accordance with known PTC technology to provide the layer 28 with a resistance of about 15 ohms and a resistivity of about 33,000 ohm-cm. Preferably, the layer 28 has a thickness between 0.018 and 0.034 inch, and the layer 28 is laminated between two sheets of copper foil 32 and 33 each having a thickness preferably within a range of 0.00075 and 0.0015 inch. Preferably, the PTC layer 28 has a uniform thickness within a range of 10 to 50 times the thickness of the metal or copper foils 32.

A layer 36 of pressure sensitive adhesive is coated on the outer copper foil 33 and is normally protected by a stripable release paper 38. The heater assembly 25 is attached to the mirror 18 by removing the protective sheet 38 and pressing the adhesives layer 36 on the heater assembly 25 firmly against the back surface of the mirror 18.

Figure 2:
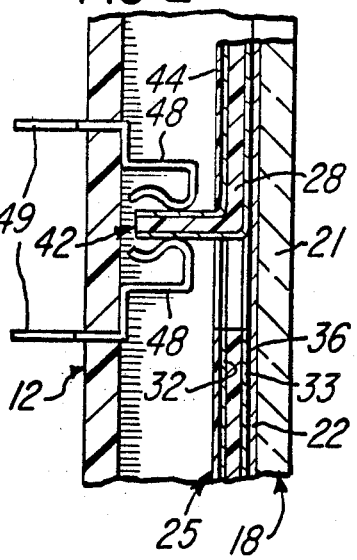
FIG. 2 is an enlarged fragmentary section of the assembly shown in FIG. 1 and illustrating the connection for power supply conductors to the heater assembly.
Figure 3:
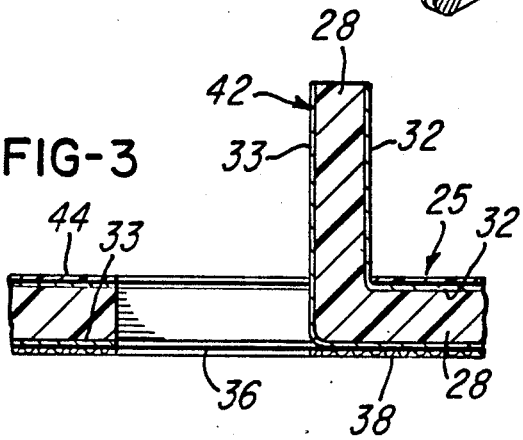
FIG. 3 is an enlarged fragmentary section of the heater assembly taken generally on the line 3—3 of FIG. 1.

As shown in FIGS. 2 and 3, a portion of the laminated heater assembly 25 is die-cut or lanced from the main planar portion of the heater assembly and is bent laterally outwardly to form a connector tab 42 which projects substantially perpendicular to the remaining portion of the heater assembly 25. A film 44 is laminated to the inner foil 32 to provide a protective covering, but the film 44 is removed from the portion of the inner foil 32 on the tab 42. Similarly, the adhesive layer 36 is omitted from the portion of the outer foil 33 on the tab 42. The heater assembly 25 is attached to the case 12 by a suitable adhesive or contact cement which contacts the bosses 13, 14 and 16 and also bonds the peripheral edge portion of the heater assembly 25 to the case 12 within the peripheral recess 10.

Referring to FIGS. 1 and 2, a pair of spring metal strips or terminals 48 are supported by the back wall of the case 12 in parallel spaced opposing relation and are located to receive the tab 42 so that the terminals 48 firmly engage the metal foils 32 and 33 of the heater assembly 25. The terminals 48 have outer male or spade end portions 49 which receive corresponding female terminals 52 on the ends of a pair of power supply conductors 54 forming part of a wiring harness. Thus when the case 12, mirror 18 and heater assembly 25 are assembled, as shown in FIG. 2, the low voltage power of the motor vehicle is supplied through the conductors 54 and through the terminals 48 to the metal conductor foils 32 and 33 so that the power is applied across the thickness of the PTC layer 28. As the temperature of the PTC layer 28 increases, the temperature of the mirror 18 increases to remove any moisture, ice and/or snow from the outer surface of the mirror 18.

Figure 4:
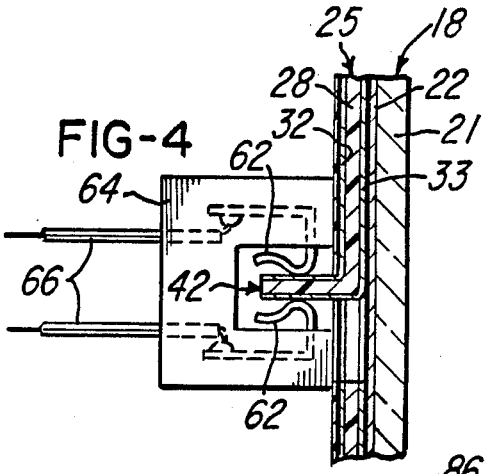
FIG. 4 is an enlarged fragmentary section of the heater assembly and showing a modified connection of the power supply conductors.

Referring to FIG. 4, a pair of metal strips or spring terminals 62 are supported by an insulated body or housing 64 which also receives the power supply conductors 66 soldered to the terminals. The terminals 62 and support housing 64 are used for connecting the conductors 66 to the heater assembly 25 when it is not desirable to have a contact terminal supported by a mirror case such as described above in connection with FIGS. 1 and 2.

Figure 5:
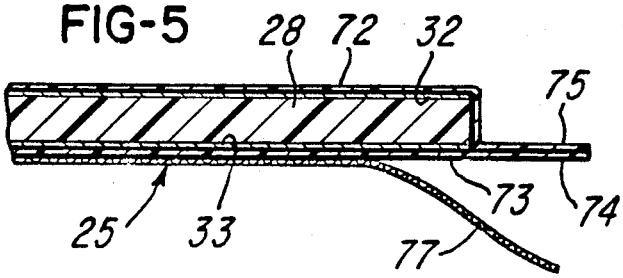
FIG. 5 is an enlarged fragmentary section of the heater assembly with a surrounding protection film.

In some uses of the heater assembly 25, for example, as a heater for a truck mirror, it is desirable to protect the heater assembly from chemical corrosion as caused, for example, by salt sprays from the road. As shown in FIG. 5, the heater assembly 25 is completely enclosed between film sheets 72 and 73 of plastics material such as MYLAR films. In this modification, the heater assembly is sandwiched or confined between the two film sheets 72 and 73 which are laminated to the heater assembly 25. The peripheral edge portions 74 and 75 of the film sheets 72 and 73 are bonded or sealed together completely around the heater assembly 25. The film sheet 73 is provided with a layer of pressure sensitive adhesive which is protected by a stripable paper cover sheet 77 and is used to bond the enclosed heater assembly 25 to the back surface of a mirror.

Figure 6:
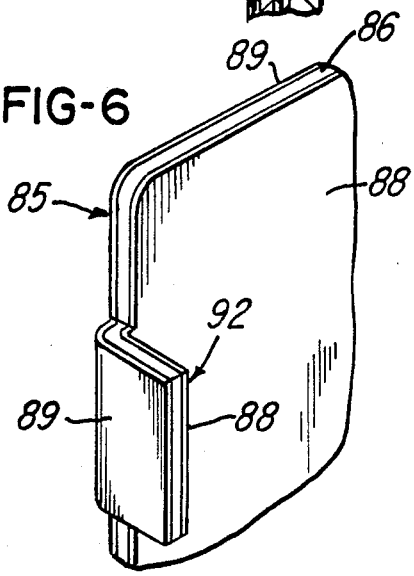
FIG. 6 is an enlarged fragmentary perspective view of a heater assembly constructed in accordance with a modification of the invention.

FIG. 6 illustrates a heater assembly 85 which is constructed substantially the same as the heater assembly 25 with a core layer 86 of PTC material sandwiched between metal foils 88 and 89. Instead of lancing the tab 42 from an inner portion of the heater assembly, as described above in connection with FIGS. 1–3, the heater assembly 85 is provided with a connector tab 92 which is formed from a peripheral edge portion of the heater assembly 85 and projects laterally outwardly in the same manner as the tab 42. The edge tab 92 is suited for use on some mirror assemblies such as a large rectangular mirror assembly used on a truck where a mirror housing surrounds the combined mirror and heater assembly 85 and has sufficient inner space for receiving a terminal connecting housing such as a housing 64 as shown in FIG. 4. While not shown, it is also within the scope of the invention to solder conductor wires directly to the metal foils on opposite sides of the connector tab.

Figure 7:
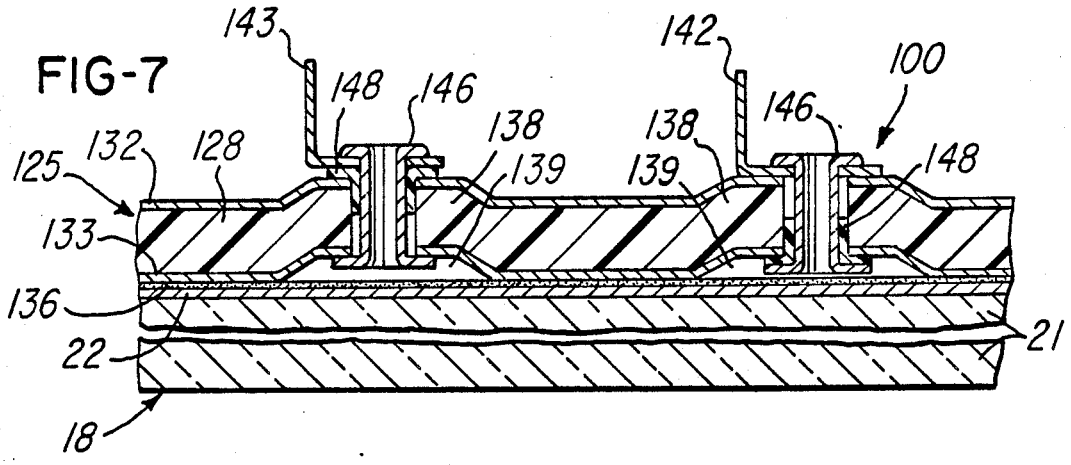
FIG. 7 is an enlarged fragmentary section showing an alternate assembly of electrical connectors.

Referring to FIG. 7 which shows another modification of the invention, a mirror assembly 100 includes a heater assembly 125 which is constructed generally the same as the heater assembly 25 described above and is attached to a mirror 18 formed by a glass sheet 21 and a reflective coating 22. The heater assembly 125 includes a core layer 128 of PTC material, and the core layer is sandwiched between copper foils 132 and 133. The mirror 18 is attached to the foil 133 by an adhesive layer 136 in the same manner as described above in connection with FIG. 2.

In the embodiment shown in FIG. 7, the heater assembly 125 is deformed with two projecting button-like portions 138 which define corresponding recesses or cavities 139. A pair of spade-like electrical terminals or tabs 142 and 143 are electrically connected to the corresponding copper foils 132 and 133 by a pair of tubular metal rivets 146 which receive corresponding plastic insulating sleeves or bushings 148. As apparent on the right side of FIG. 7, the tab 142 is electrically connected to the foil 132 and is electrically insulated from the foil 133 by the corresponding plastic sleeve or bushing 148 which separates the metal rivet 146 from the foil 133. On the left side of FIG. 7, the terminal 143 is electrically connected by the metal rivet 146 to the metal foil 133 and is electrically insulated from the copper foil 132 by the corresponding plastic bushing 148. The terminals or tabs 142 and 143 are adapted to receive corresponding press-on male-type connectors (not shown) which are attached to the ends of corresponding conductor wires 66.

From the drawings and the above description, it is apparent that a mirror and heater assembly constructed in accordance with the present invention, provides desirable features and advantages. As one primary advantage, the heater assemblies 25, 85 and 125 may be efficiently produced by laminating two strips of metal or copper foils to an extruded PTC layer. Preferably, the lamination is performed as a continuous process where the foils are supplied from coils located on opposite sides of an extruder head. The adhesive layer 36 and protective sheet 38 and protective film 44 are also applied or laminated to the metal foils on a continuous basis in order to form large sheets of the laminated heater materials. The large sheets are then die-cut according to the size and shape of the mirror, after which each die-cut piece is lanced or bent to form a connector tab 42 or 92 or is punched with holes and provided with attached connector tabs 142 and 143.

As another important advantage, by having the laminated heater assembly 25 or 85 or 125 cover the entire back surface of the mirror, the heater assembly senses the variations in temperature of the mirror over its entire area and provides additional wattage in the areas where the mirror is the coldest. Thus when the heater assembly is energized, the electrical power or wattage is first used to melt any snow and/or ice on the mirror, and only after the temperature of the mirror has become uniform, does the heater assembly provide uniform heating of the mirror. Another desirable advantage of the heater assembly 25 is the simplified means for attaching electrical conductors to the metal foils by use of the laterally projecting tab 42 or 92. The tab provides for a quick and simple attachment of the foils to the conductors by means of the spring metal terminals and thereby provides for simplified assembling of the mirror, heater and support case. In addition, the attachment of the terminals or tabs 142 and 143 of the heater assembly 125 provides for conveniently and inexpensively connecting conductor wires to both of the foils 132 and 133 from the inner side of the heater assembly 125.

While the forms of mirror and heater assembly and the methods of producing the heater assembly herein described constitute preferred embodiments of the invention, it is to be understood that the invention is not limited to these precise forms and methods, and that changes may be made therein without departing from the scope and spirit of the invention as defined in the appended claims.

The invention having thus been described, the following is claimed:

1. A mirror and heater assembly comprising a mirror having a predetermined shape and size, a single layer of conductive polymer having opposite parallel flat surfaces providing said layer with a substantially uniform thickness, said polymer having a positive temperature coefficient of resistivity, a set of continuous metal foils bonded to said opposite surfaces of said layer and cooperating to form a laminated heater assembly having a uniform thickness with only said single layer of said polymer between said foils, said metal foils and said polymer layer having the same size and shape, means for attaching one of said metal foils forming one side of said heater assembly to said mirror, an integral portion of said laminated heater assembly projecting laterally outwardly from the plane of said heater assembly to form a connecting tab, means for connecting a pair of electrical conductors to the portions of said metal foils on said tab, and said heater assembly being effective to heat substantially the entire mirror according to variations in temperature of different areas of the mirror.

2. Apparatus as defined in claim 1 wherein said connecting tab is spaced inwardly from the peripheral edge of said heater assembly and forms a hole through said heater assembly.

3. Apparatus as defined in claim 1 wherein said portion of said heater assembly forming said tab comprises a peripheral edge portion of said heater assembly.

4. Apparatus as defined in claim 1 wherein said connecting means comprise a set of electrical conductive spring terminals engaging said metal foils on said portion forming said tab.

5. Apparatus as defined in claim 4 and including a mirror case of molded plastics material for supporting the mirror and said heater assembly, and said case supports said terminals in position to engage said metal foils on said tab.

6. Apparatus as defined in claim 4 and including a connector body of electrical insulating material and supporting said spring terminals.

7. Apparatus as defined in claim 1 and including a film of plastics material surrounding said heater assembly and providing a protective enclosure for said heater assembly.

* * * * *